US005671673A

United States Patent [19]

Bööse et al.

[11] Patent Number: 5,671,673

[45] Date of Patent: Sep. 30, 1997

[54] CHAMBERED DOCTOR BLADE DEVICE FOR PRINTING UNIT

[76] Inventors: Åke Bööse, Laxvägen 3 S-181 30, Lidingö ; Jan Stenqvist, Mosshult 3580 S-260 60, Kvidinge, both of Sweden

[21] Appl. No.: 618,398

[22] Filed: Mar. 19, 1996

Related U.S. Application Data

[63] Continuation of Ser. No. 343,572, Nov. 22, 1994, abandoned.

[30] Foreign Application Priority Data

May 22, 1992 [SE] Sweden ..... 9201610

[51] Int. Cl.[6] ..... B41F 31/04; B41F 31/06

[52] U.S. Cl. ..... 101/363

[58] Field of Search ..... 101/157, 350, 101/351, 352, 363, 366, 147, 148, 207, 208, 209, 210, 169; 118/259, 261; 15/256.5, 256.51

[56] References Cited

U.S. PATENT DOCUMENTS

| | | | |
|---|---|---|---|
| 2,377,110 | 9/1945 | Smith | 101/157 |
| 3,901,150 | 8/1975 | Kirby, Jr. | 101/351 |
| 4,581,995 | 4/1986 | Stone . | |
| 4,716,829 | 1/1988 | Wenzel | 101/425 X |
| 4,998,475 | 3/1991 | John et al. . | |
| 5,009,159 | 4/1991 | Stenqvist . | |
| 5,213,037 | 5/1993 | Leopardi | 101/363 |
| 5,226,364 | 7/1993 | Fadner | 101/366 |

FOREIGN PATENT DOCUMENTS

| | | |
|---|---|---|
| 0 128 411 | 5/1984 | European Pat. Off. . |
| 0 222 118 | 9/1986 | European Pat. Off. . |
| 0 350 839 | 7/1989 | European Pat. Off. . |
| 0 389 922 | 3/1990 | European Pat. Off. . |
| 0 438 731 | 12/1990 | European Pat. Off. . |
| B-468754 | 3/1993 | Sweden . |
| WO89/07047 | 8/1989 | WIPO . |
| WO91/18744 | 12/1991 | WIPO . |

*Primary Examiner*—J. Reed Fisher

*Attorney, Agent, or Firm*—Merchant, Gould, Smith, Edell, Welter & Schmidt, P.A.

[57] ABSTRACT

A chambered doctor blade device intended for a printing unit and adapted to coat a rotatable cylinder (2) with ink, lacquer, adhesive or the like, comprises an elongate frame (8) which is arranged parallel to and outside the cylinder (2) and on which are mounted two parallel, elongate and spaced-apart doctor blades (9,10) to be resiliently and scrapingly applied against the cylinder (2) in operative position. An elongate chamber (11) holding ink (12) or the like is defined by the doctor blades (9,10), the surface of the frame (8) facing the cylinder (2), and the circumferential surface of the cylinder (2). To achieve good flexural and torsional rigidity, the frame (8) comprises at least two elongate interconnected metal sections (13,14) which are made of bent thin sheet-metal, preferably of stainless steel, and by means of which the elongate portion of the frame (8) located between the mounting places for the doctor blades (9,10) forms an elongate stiffening or reinforcing portion. Such a frame (8) ensures, in operation, a set constant distance between the frame (8) and the cylinder (2) and, consequently, constant application of the doctor blades (9,10) against the cylinder (2).

14 Claims, 5 Drawing Sheets

CHAMBERED DOCTOR BLADE DEVICE FOR PRINTING UNIT

This is a File Wrapper Continuation application of application Ser. No. 08/343,572, filed as PCT/SE93/00447 May 19, 1993 published as WO93/24328 Dec. 9, 1993, now abandoned.

FIELD OF THE INVENTION

This invention relates to a chambered doctor blade device, in the following also referred to as chambered doctor blade, for a printing unit. More precisely, the invention concerns a chambered doctor blade of the type defined in the preamble to appended claim 1. In addition, the invention relates to a printing unit equipped with such a chambered doctor blade.

BACKGROUND OF THE INVENTION

Chambered doctor blades are extensively used in rotary-printing units, especially flexo-printing units, for applying ink, lacquer, adhesive or the like to a rotatable cylinder included in the printing unit. In a flexo-printing unit, the chambered doctor blade serves to ink the screen roller, i.e. fill the cells or recesses of the roller with printing ink. The inking of the screen roller is essential for the printing result. It is of special importance that the screen roller is uniformly inked, which means that the distance between the roller and the doctor blades have to be accurately set. As a result, the chambered doctor blade, usually clamped in the machine frame of the printing unit, has to exhibit good flexural and torsional rigidity.

Prior-art chambered doctor blades therefore comprise a sturdy frame, which usually is solid and made in one piece and on which the doctor blades are mounted. EP-A0 350 839 and WO-A-89/07047, for instance, teach chambered doctor blades of this type.

Conventionally, such doctor blade frames are made of solid cast iron or aluminium, or compression-moulded blanks of iron or aluminium provided with stiffening springs to reduce their weight. However, these known constructions suffer from some serious drawbacks. First, the chambered doctor blade becomes very heavy and unwieldy and is thus difficult to dismount from the printing unit, e.g. when to be cleaned or replaced. It usually takes two people to dismount a cast-iron chambered doctor blade. Second, one casting mould is needed for each length of chambered doctor blade. Third, the cast-iron structure naturally is liable to corrosion, which constitutes a serious inconvenience, since the printing ink to be circulated in the chamber often contains corrosive components.

The market also provides doctor blade frames consisting of extruded aluminum sections in one piece, but these do not offer any satisfactory solution to the above problems. If to withstand the contemplated strains and to obtain sufficient flexural and torsional rigidity, the aluminium sections have to be comparatively thick, and the chambered doctor blade will thus after all become unnecessarily heavy. Furthermore, also the aluminum sections are liable to corrosion, since the printing ink often contains basic substances aggressive on aluminium.

In addition to the requirements discussed in the foregoing, the ink chamber naturally has to be sealed. The doctor blade that removes excess ink, for the contemplated direction of rotation of the roller, is the operative doctor blade, and the other doctor blade merely has a sealing function. When the direction of rotation is reversed, it naturally is the other way round. The two doctor blades have to be applied against the circumferential surface of the screen roller in precisely the right way for the ink to be evenly distributed on the roller and to minimise the amount of ink dripping from the lower doctor blade (when being the sealing one). Moreover, special seals are required at each end of the chamber. In this respect, reference is made to U.S. Pat. No. 4,581,995, which teaches a sealing unit placed at the end of an ink chamber and consisting of a pressure and labyrinth seal made up of several thin sealing lamellae of polymeric material.

OBJECTS OF THE INVENTION

One object of this invention is to provide a chambered doctor blade device that, despite its low weight, has sufficient flexural and torsional rigidity to ensure that a rotating cylinder is evenly coated with ink or the like.

Another object of the invention is to provide a chambered doctor blade device that is easy to clean and maintain, especially when it comes to replacing the seals.

A further object of the invention is to provide a chambered doctor blade device that is not liable to corrosion from the liquid, e.g. printing ink, held in the chamber.

Yet another object of the invention is to provide a chambered doctor blade device that, when suitably sealed, enables a controllable liquid flow in the chamber as well as a constant level of liquid therein and that limits the total volume of liquid needed in the circulation system.

A special object of the invention is to provide a chambered doctor blade device that is made up of few components and thus is simple and inexpensive to produce.

SUMMARY OF THE INVENTION

These and other objects, apparent from the following description, are achieved by a chambered doctor blade device which is of the type stated by way of introduction and which in addition exhibits the features recited in the characterising clause of appended claim 1. Preferred embodiments of the inventive chambered doctor blade device are defined in appended subclaims 2–10. An inventive printing unit is defined in appended claim 11.

The invention is based on the idea of the frame of the chambered doctor blade being, in order to achieve a good stiffening and reinforcing effect, composed of an assembly of interconnected metal sections. According to the main idea of the invention, the frame composed of metal sections should form a flexurally and torsionally rigid unit which ensures a constant distance between the frame and the cylinder against which the doctor blades are to be applied, thereby to attain the objects of the invention.

By designing the frame in this way, the whole chambered doctor blade can be of much lighter and more slender construction than possible hitherto, Without lowering the standards of strength.

DESCRIPTION OF THE DRAWINGS

The invention and its many advantages will be described in more detail below with reference to the accompanying drawings showing, by way of example only, a currently preferred embodiment of an inventive chambered doctor blade. In the drawings.

DESCRIPTION OF A PREFERRED EMBODIMENT

Figure 1:
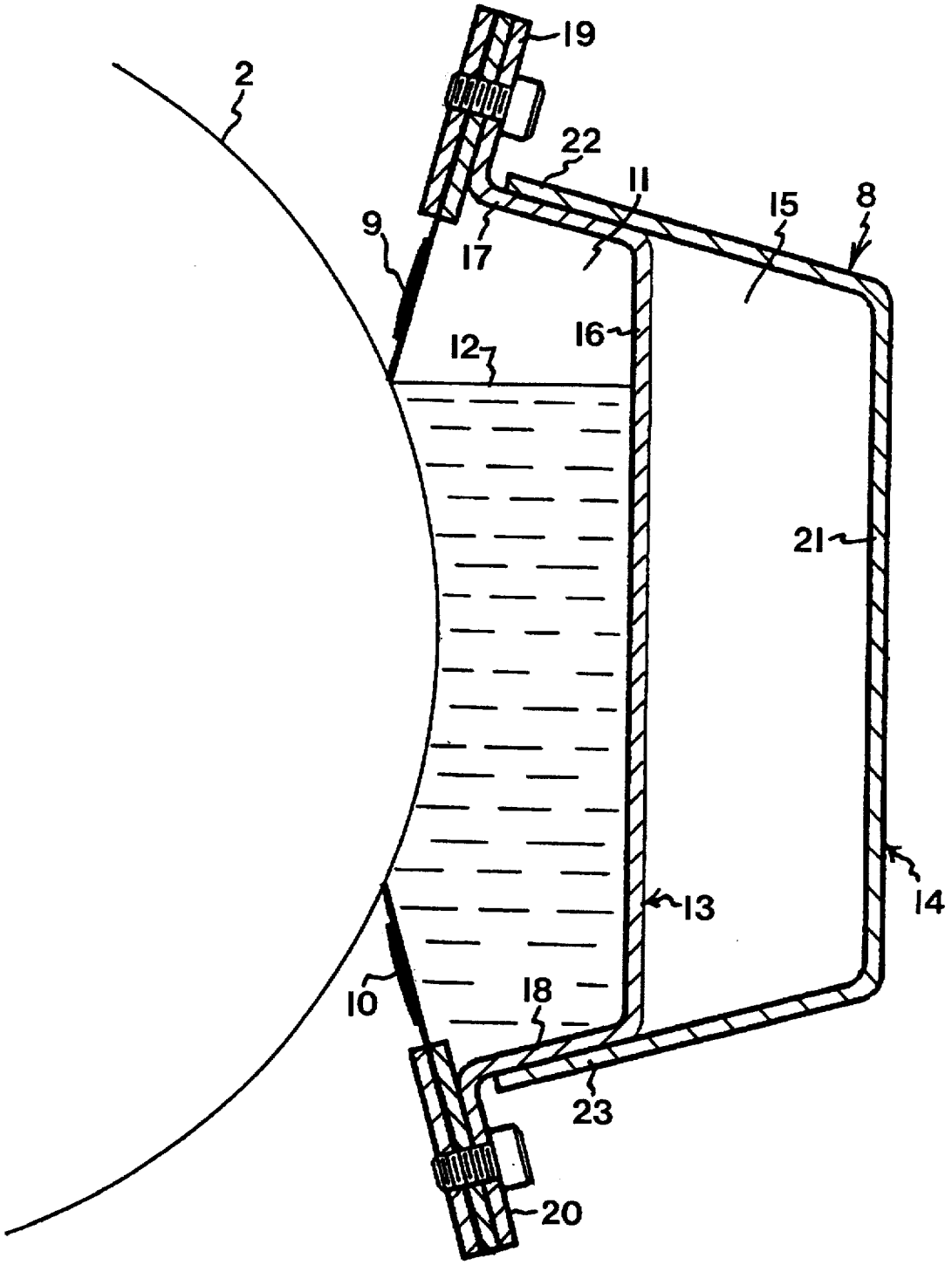
FIG. 1 is a schematic cross-section of a chambered doctor blade device according to the invention.

In the drawings, a chambered doctor blade device, here also referred to as chambered doctor blade, is generally designated 1. The chambered doctor blade 1 is intended for use in a printing unit, such as a rotary-printing unit, especially a flexo-printing unit, where a rotatable cylinder 2, especially a screen roller, is to be coated with ink, lacquer, adhesive or the like. By means of a special suspension element 3, the chambered doctor blade 1 is mounted in the machine frame of the printing unit. In the drawings, the machine frame is in the form of two side members 4 and 5, which in known manner are provided with guides 6, 7 for moving the chambered doctor blade 1 in relation to the cylinder 2 (see FIG. 2).

As shown most clearly in FIG. 1, the chambered doctor blade 1 comprises a frame, generally designated 8, on which two elongate doctor blades 9, 10 are mounted. The doctor blades 9, 10 are adapted to be restliently and wipingly applied against the cylinder 2 in operative position. In this position, the doctor blades 9, 10 define, together with the surface of the frame 8 facing the cylinder 2 and the circumferential surface of the cylinder 2, an elongate chamber 11 holding printing ink 12 to be applied to the rotating cylinder 2.

The elongate frame 8 is parallel to and located outside the cylinder 2. The two doctor blades 9, 10 are parallel to each other and to the cylinder 2.

To achieve good flexural and torsional rigidity, the frame 8 comprises at least two elongate, interconnected metal sections 13, 14 made of bent thin sheet-metal, preferably of stainless steel. The elongate portion of the frame 8 located between the mounting places for the doctor blades 9, 10 will thus form an elongate stiffening or reinforcing structure, and the frame 8 will thus constitute a flexurally and torsionally rigid unit which in operation ensures a set constant distance between the frame 8 and the cylinder 2 and, consequently, constant application of the doctor blades 9, 10 against the circumferential surface of the cylinder 2. As a result, the metal sections 13, 14 together form a closed hollow section having an elongate channel 15 between them, to be described further below.

The first metal section 13 of the frame 8, which is located closest to the cylinder 2, has a substantially U-shaped cross-section comprising a web 16 and two flanges 17, 18 which are directed towards the cylinder 2 and which in turn have mounting flanges 19, 20 on which the doctor blades 9, 10 are detachably mounted.

The second metal section 14 of the frame 8, which is located outside the first metal section 13 with respect to the cylinder 2, also has a U-shaped crossesection comprising a web 21 which is parallel to and located at a distance from the web 16 of the first metal section 13, as well as flanges 22, 23 connected to the flanges 17, 18 of the first metal section to form the above-mentioned hollow section with the elongate channel 15 defined between the webs 16, 21 of the metal sections 13, 14. Preferably, the metal sections 13, 14 are interconnected by their respective flanges 17, 22 and 18, 23 being glued together and spot welded. However, it will be appreciated that the two metal sections 13, 14 may be interconnected in some other way.

The frame 8 composed of two metal sections 13, 14 thus assumes the shape of a hollow section, resulting in a lightweight frame 8 of excellent flexural and torsional rigidity. This slender, yet strong frame 8 has considerable advantages as compared with similar prior-art chambered doctor blades, discussed by way of introduction. The light frame 8 makes the inventive chambered doctor blade 1 very easy to handle, e.g when to be dismounted.

Tests have shown that a frame 8 composed of metal sections 13, 14 made of thin sheet-metal approximately 1–3 mm thick gives excellent results. However, the invention is not restricted to any particular type of thin sheet-metal. However, thin sheet-metal of stainless steel is advantageously used to avoid corrosion.

Figure 2:
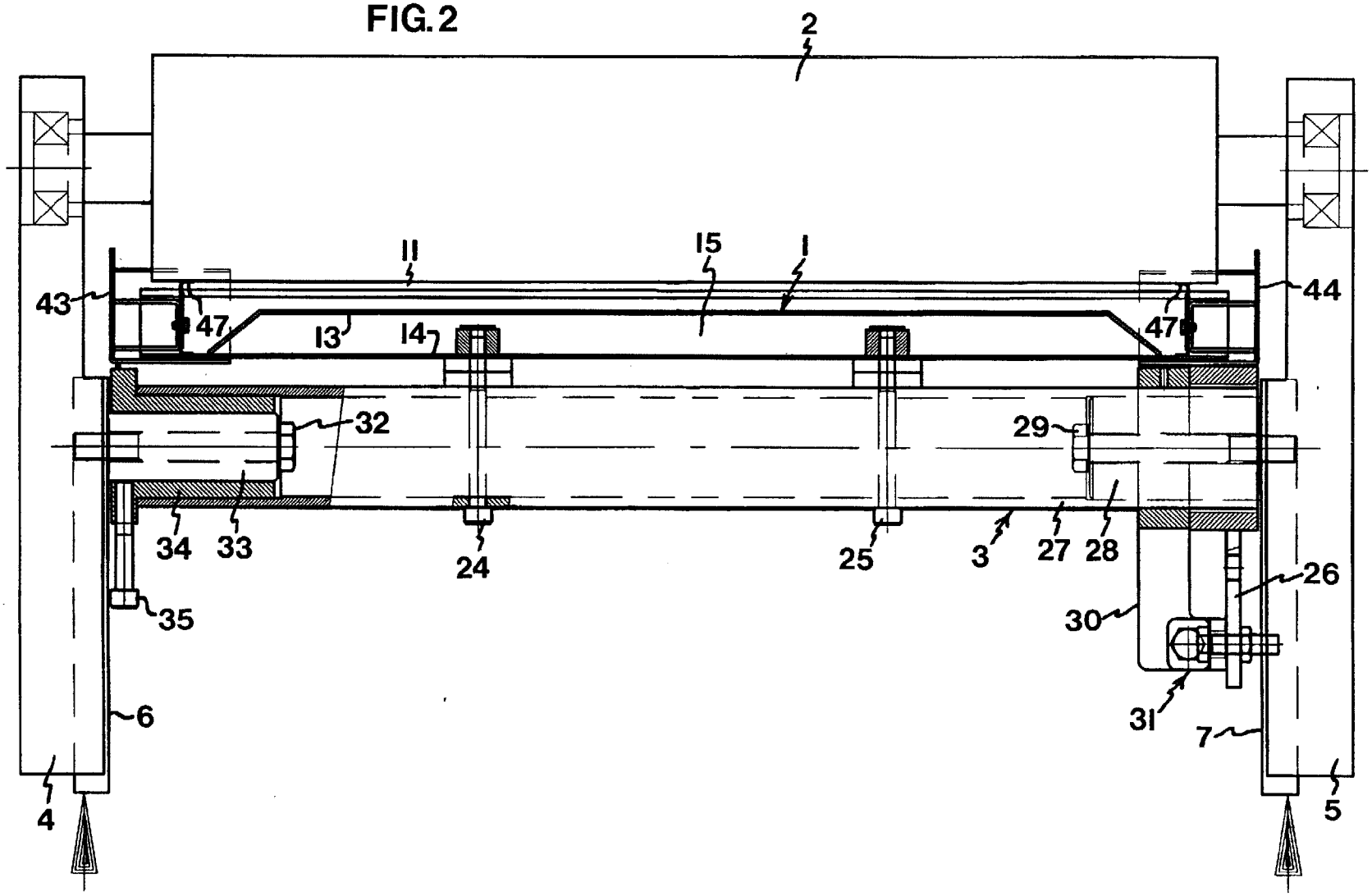
FIG. 2 is a part-sectional top view showing the chambered doctor blade device mounted in a printing unit.

As shown in FIG. 2, the chambered doctor blade 1 is attached, by bolt joints 24 and 25, to the suspension element 3 mounted in the machine frame 4, 5. The suspension element 3 has means for parallel adjustment of the frame 8 in relation to the cylinder 2 as well as angular adjustment of the frame 8 with a view to changing the application of the doctor blades 9, 10 against the cylinder 2.

Figure 3:
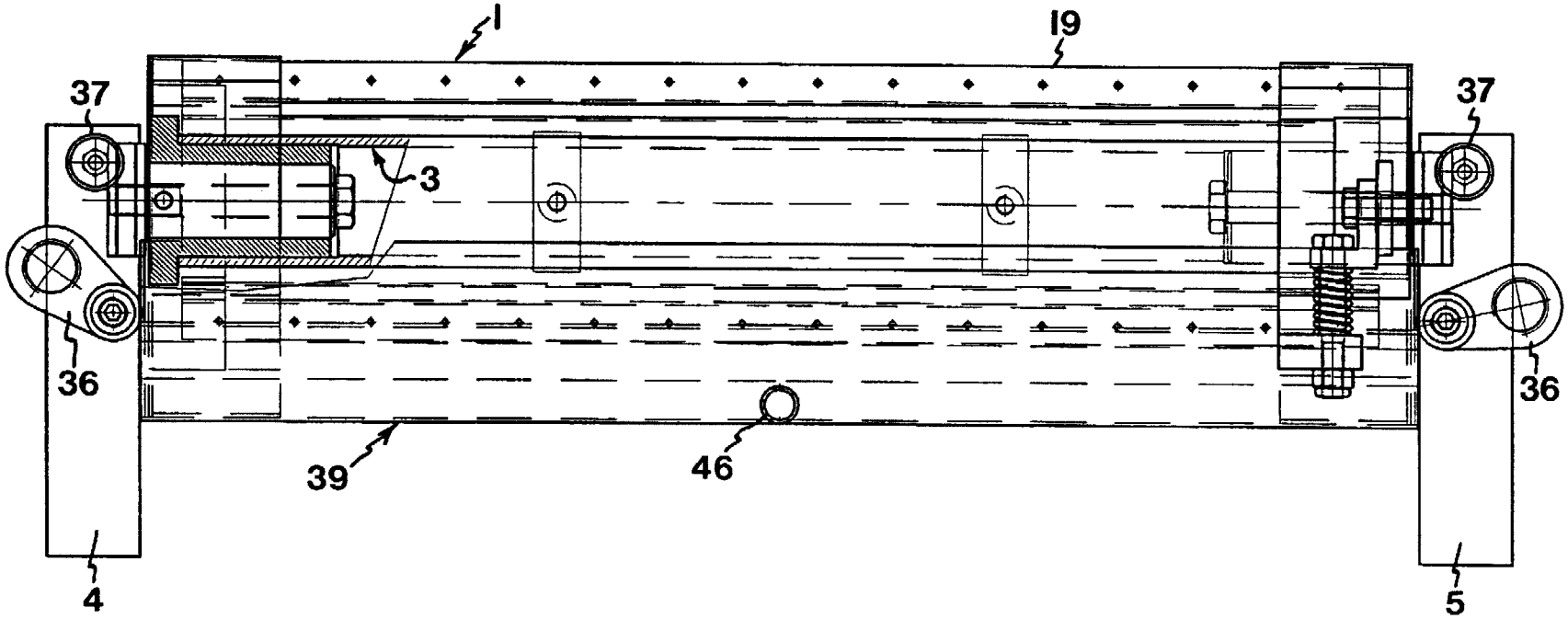
FIG. 3 is an elevational view from behind of the chambered doctor blade device shown in FIG. 2.

The adjusting means are illustrated in FIGS. 2 and 3. A first lever 26 is articulated to a tube 27 on the same side as a pivot pin 28 and the guide 7. The connection to the guide 7 is achieved by a bolt 29, and a second lever 30 is fixedly connected to the tube 27. An assembly 31 made up of a screw, a nut and a spring makes it possible to alter the angle between the levers 26 and 30, thereby altering the application pressure of the doctor blades 9, 10 against the cylinder 2. The pressure on the upper doctor blade 9 is either increased or decreased, and vice versa, for the lower doctor blade 10.

At the other end, the suspension element 3 comprises a bolt 32 and a pivot pin 33 surrounded by an eccentric sleeve 34 inside the tube 27. The eccentric sleeve 34 can be rotated about the pivot pin 33 and be locked in relation thereto by a screw 35. The arrangement also includes springs 36 (see FIGS. 4 and 5) intended to push the guides 6, 7 forwards towards the cylinder 2, as is schematically illustrated by arrows in FIG. 2. This movement is limited by adjusting screws 37 (see FIG. 3). By these screws, the distance and the parallelism between the cylinder 2 and the doctor blades 9, 10 are set in the x–z plane. The positions of the doctor blades 9, 10 in the y–z plane are adjusted by the eccentric sleeve 34.

Figure 4:
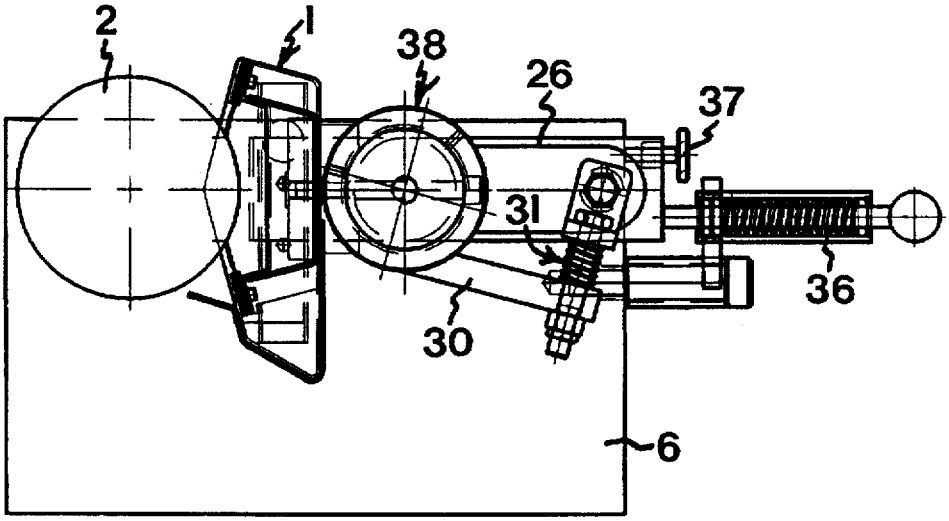
FIGS. 4 and 5 are side views showing the chambered doctor blade device of FIGS. 2 and 3 in, respectively, operative position and inoperative position.
Figure 5:
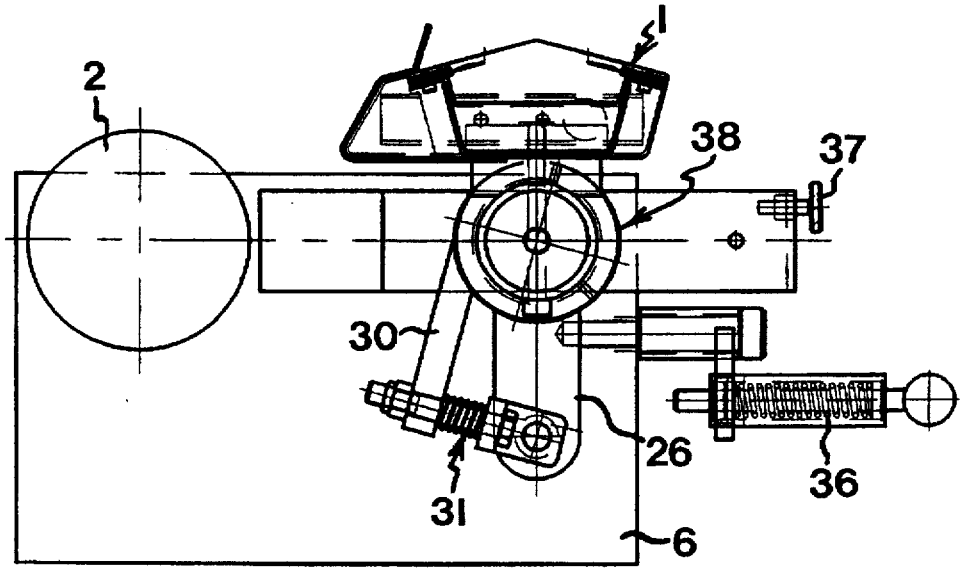

If the spring action exerted by the springs 36 is relieved, the chambered doctor blade 1 can be moved back away from the cylinder 2, If, in this removed position, the connection between the lever 26 and the guide 7 is released, the suspension element 3, and thus the whole chambered doctor blade 1, can be pivoted about the pivot pins 28, 33, as shown in FIGS. 4 and 5. Thus, the chambered doctor blade 1 is easily inspected and the doctor blades 9, 10 are easily cleaned in a service position. By a suitable choice of mounting points in the machine frame, the chambered doctor blade 1 can be locked in the desired position. The mounting of the chambered doctor blade 1 is schematically illustrated in FIGS. 4 and 5 and generally designated 8.

Many parameters can be altered by the adjusting means 24–38 described in the foregoing, whereby to achieve much simpler and more accurate adjustment of the chambered doctor blade 1 in relation to the cylinder 2 than has hitherto been possible by known adjusting means.

Figures 6, 7, 8:
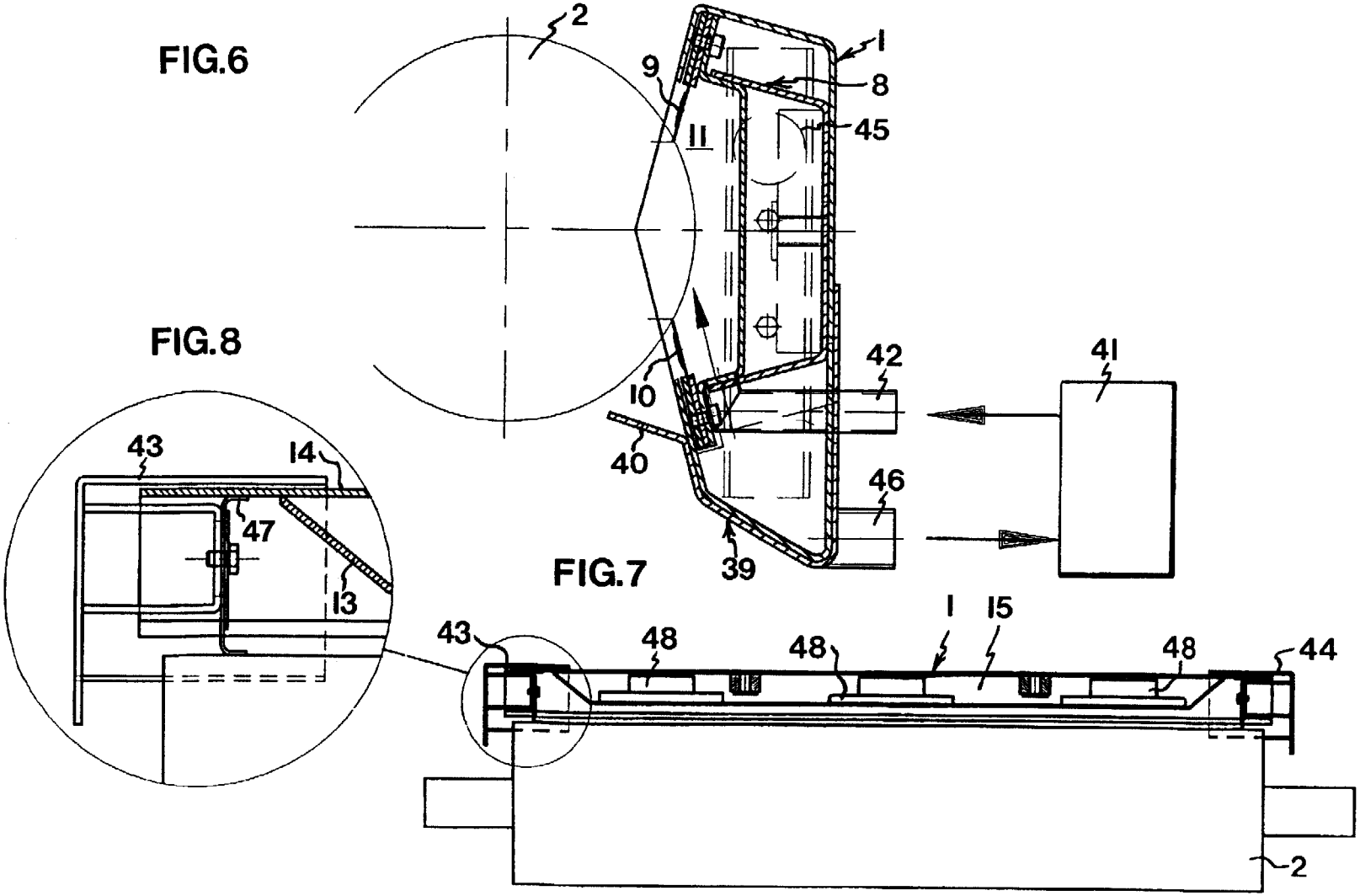
FIG. 6 is a slightly enlarged, schematic cross-section of the chambered doctor blade device of FIGS. 4 and 5.
FIG. 7 is a schematic longitudinal section of the chambered doctor blade device.
FIG. 8 is an enlarged view of a part of FIG. 7.

Reference is now made to FIG. 6, which illustrates a circulation system for the ink 12 with which the cylinder 2 is to be coated. The frame 8 of the chambered doctor blade 1 is enclosed in a cover comprising a collecting drain 39 with an inclined flange 40 disposed below the lower doctor blade 10. The flange 40 collects any ink that may drip from the lower doctor blade 10. The ink is pumped from an ink container 41 and through an inlet 42 into the chamber 11 of the chambered doctor blade 1. At each end, the chamber 11 is closed by an end cover 43, 44 (see FIG. 7). Each end cover 43, 44 has an overflow port 45 where excess ink flows out of the chamber 11 to be collected in the collecting drain 39. The ink is recycled to the container 41 through an outlet 46 of the collecting drain 39 (see FIG. 3). This circulation system ensures a controlled ink flow in which the total amount of ink can be limited. This is a considerable advantage, the price of printing ink having increased considerably in recent years. Also, spillage is much reduced by the provision of the collecting drain 39 with the associated drip-collecting flange 40.

Furthermore, it is essential to be able to control the level of liquid in the chamber 11, which is easily done by displacing the ports 45 of the end covers 43, 44 (not shown).

Thus, it is important to minimise the total amount of ink to be supplied to the circulation system of the chambered doctor blade 1 for filling the chamber 11. The collecting drain 39 should be relatively narrow and be provided adjacent to the chamber 11.

When printing limited editions, the inking system in conventional chambered doctor blades requires a large amount of ink to enable efficient printing, as compared with the amount of ink actually used in printing. To reduce the circulated amount of ink in the printing of limited editions, the container 41 can be dispensed with, and return ink may instead be pumped directly from the outlet 46 to the inlet 42.

As mentioned by way of introduction, it is of the utmost importance that the chamber 11 is suitably sealed. For this purpose, the end covers 43, 44 are equipped with an internal elastic seal 47 (see FIG. 8) which is sealingly applied against the inside of the inner metal section 13, the circumferential surface of the roller 2 and the insides of the doctor blades 9, 10.

The seal 47 ensures that the level of liquid in the chamber 11 is sufficiently high. For satisfactory operation, this level should be so high .that the entire portion of the cylinder 2 located between the doctor blades 9, 10 is covered with ink (see FIG. 1).

The circumferential portion of the seal 47, preferably made of teflon, is directed inwards towards the chamber 11. In tests, this arrangement has been found to be satisfactory. As appears from FIG. 8, the chamber 11 is widened at the ends by the inner metal section 13 being so designed at the ends that the distance to the circumferential surface of the cylinder 2 increases, thereby giving the chamber 11 a larger cross-sectional area at the two end portions than at the central portion (cf. FIG. 7). This design results in an improved liquid flow at the ends of the chamber 11, while at the same time the main part of the chamber 11 can be extremely narrow, which considerably reduces the volume of ink. Another advantage is that the bent circumferential portion of the teflon seal 47 may extend a distance into the chamber 11, where it is worn in use. This bent portion increases the lifespan of the seal 47, since the seal does not have to be replaced until the entire circumferential portion has been worn down. When the seal 47 is to be replaced, the removable end cover 43 is axially pulled off from the frame 8.

As indicated earlier, the flanges 17, 22 and 18, 23 of the metal sections 13 and 14, respectively, are sealingly interconnected in the longitudinal direction so as to form the longitudinal channel 15 in the frame 8. As shown in FIG. 7, the channel 15 is sealed at both ends to form a hermetically sealed compartment. Because the frame 8 thus assumes the shape of a closed hollow section, the compartment in the channel 15 never comes into contact with the printing ink or the surrounding atmosphere.

This compartment can be utilised by placing transducers 48 for inducing high-frequency sound inside the channel 15. In FIG. 7, there are shown three transducers 48, which preferably are glued onto the web 16 of the metal section 13 which is closest to the cylinder 2 inside the channel 15. The transducers 48 are connected to a high-frequency generator (not shown). When the generator is switched on, the ink in the chamber 11 is caused to oscillate at the same frequency as the transducers 48, which has been found to be extremely advantageous. First, the filling of the cells of the cylinder or screen roller 2 is improved to a certain extent because the ink 12, oscillating at a high frequency, eliminates or at least considerably reduces the risk of air gaps forming at the bottom of the cells emptied when ink was transferred to the printing block (not shown). Second, the ink 12, oscillating at a high frequency, entrains any ink that has dried in the cells of the screen roller 2, thereby improving the capacity of the roller 2 to entrain ink. Third, air from cells in the screen roller 2 emptied of ink is largely prevented from entering the chamber 11 to be admixed to the ink 12. Such admixture of air is disadvantageous, Since it may considerably alter the viscosity of the ink 12.

When manufacturing the frame 8, the transducers 48 are glued onto the dry side of the first metal section. 13, whereupon the second metal section 14 is connected thereto. The sealed frame 8 holding the transducers 48 thus forms a sealed cavity making it possible to arrange the required electrical connections (not shown) outside the danger zone for explosions of the printing unit. The size of this zone varies according to the amount of solvent in the printing ink.

Furthermore, the chambered doctor blade 1 can be used also in inflammable environments, because the transducers 48 are mounted inside the hermetically sealed channel 15 of the frame 8. Thus, any sparks generated cannot cause a fire.

It is particularly advantageous that the entire chambered doctor blade 1, after being dismounted, can be immersed in a cleaner bath (not shown) and washed by the transducers 48 being caused to oscillate by means of the high-frequency generator. Being fixed directly on the dry side of the metal section 13 communicating with the ink chamber 11, the oscillating transducers 48 can act precisely where the ink is to be removed in cleaning.

A further advantage is that the oscillating chambered doctor blade immersed in the cleaner bath helps to clean also other objects in the bath, e.g. blocks and end seals.

DESCRIPTION OF FURTHER EMBODIMENTS

In an inventive embodiment, not shown or described in detail here, use is made of another assembly of interconnected metal sections. In this case, the second metal section 14 of the frame 8 is replaced with an elongate tubular metal element which, by throughgoing mounting screws, is attached to a first section corresponding to the U-section 13.. The mounting screws extend right through the tubular section, through a hole in the inner section, and are finally screwed into counterplates arranged on the inside of the inner section. If need be, spacer plates further stiffening the arrangement can be provided between the tubular section and the inner U-section. Such a frame has been found to possess excellent stiffening properties.

Finally, it should be pointed out that the invention is by no means restricted to the embodiments described in the foregoing, and several modifications are thus conceivable within the scope of the invention as defined in the appended claims. For instance, the metal sections of the frame can be otherwise designed, provided that the required stiffening or reinforcing effect as well as the flexural and torsional rigidity are achieved. Naturally, the frame may be composed of more than two metal sections. Although the invention is especially applicable to the coating of a screen roller with ink, it may also be used for applying lacquer, adhesive or the like on some other type of cylinder.

We claim:

1. A chambered doctor blade device for a printing apparatus having a rotatable cylinder, which is adapted to apply a printing material to, the rotatable cylinder, the device comprising:

an elongate frame being disposed parallel to and outside the cylinder;

an elongate and spaced-apart doctor blade being mounted on each side of the elongated frame, said blades being disposed parallel to the cylinder and arranged, in an operative position, to be resiliently and wipingly applied against the cylinder, the blades, when in said operative position, defining, together with a surface of the elongate frame facing the cylinder and a circumferential surface of the cylinder, an elongate chamber which holds the printing material to be applied to the rotating cylinder; and the elongate frame including at least two elongate, interconnected metal sections, the two blades being mounted on two ends of a first metal section, respectively, and a second metal section being disposed between mounting positions of the blades, the elongate metal sections of the elongate frame forming an elongate stiffening or reinforcing portion to constitute a flexurally and torsionally rigid unit which in operation ensures a set constant distance between the elongate frame and the cylinder and, consequently, constant application of the blades against the circumferential surface of the cylinder.

2. A device as set forth in claim 1, wherein a closed hollow section is formed between the first and second metal sections.

3. A device as set forth in claim 2, wherein the first metal section of the frame is closest to the cylinder and has a substantially U-shaped cross-section comprising a web located at a distance from the circumferential surface of the cylinder, two flanges directed towards the cylinder and two mounting flanges on which the doctor blades are detachably mounted, the second metal section of the frame, which is disposed outside the first metal section with respect to the cylinder, having a substantially U-shaped cross-section comprising a web located at a distance from the web of the first metal section and two flanges connected to the two flanges of the first metal section so as to form said closed hollow section with an elongate channel defined between the webs of the first and second metal sections.

4. A device as set forth in claim 3, wherein the flanges of the first and second metal sections are sealingly interconnected in a longitudinal direction to form said elongate channel, which in addition is sealed at each end to form a hermetically sealed compartment in the elongate channel.

5. A device as set forth in claim 1, wherein the first metal section is closest to the cylinder and is so designed at its ends that a distance from the first metal section to the circumferential surface of the cylinder increases at said two ends, so that the chamber has a larger cross-sectional area at two end portions than at a central portion.

6. A device as set forth in claim 1, wherein the elongate chamber is closed at each end by a removable end cover having an internal elastic seal, which sealingly engages inside of the first metal section located closest to the cylinder, the circumferential surface of the cylinder and inside of the blades.

7. A device as set forth in claim 6, further comprising an ink circulation system having an inlet to the elongate chamber, overflow ports formed in said removable end covers, and a collecting drain communicating with said overflow ports and having an outlet which communicates with an ink container.

8. A device as set forth in claim 1, wherein said interconnected metal sections are made of bent thin sheet-metal.

9. A device as set forth in claim 8, wherein said sheet-metal is stainless steel.

10. A printing apparatus, comprising:

a chambered doctor blade device having a rotatable cylinder, the device being adapted to apply a printing material to the rotatable cylinder, the device comprising:

an elongate frame being disposed parallel to and outside the cylinder;

an elongate and spaced-apart doctor blade being mounted on each side of the elongated frame, said blades being disposed parallel to the cylinder and arranged, in an operative position, to be resiliently and wipingly applied against the cylinder, the blades, when in said operative position, defining, together with a surface of the elongate frame facing the cylinder and a circumferential surface of the cylinder, an elongate chamber which holds the printing material to be applied to the rotating cylinder;

the elongate frame including at least two elongate, interconnected metal sections, the two blades being mounted on two ends of a first metal section, respectively, and a second metal section being disposed between mounting positions of the blades, the elongate metal sections of the elongate frame forming an elongate stiffening or reinforcing portion to constitute a flexurally and torsionally rigid unit which in operation ensures a set constant distance between the elongate frame and the cylinder and, consequently, constant application of the blades against the circumferential surface of the cylinder; and a machine frame, the device being pivotally mounted in the machine frame, such that the entire device can be pivoted away from the cylinder to an inoperative position.

11. A printing apparatus as set forth in claim 10, wherein the device is mounted in the machine frame by means of a suspension element on which the elongate frame is mounted and which has means for parallel adjustment of the elongate frame in relation to the cylinder as well as for angular adjustment of the elongate frame for changing application of the blades against the cylinder.

12. A chambered doctor blade device for a printing apparatus having a rotatable cylinder, which is adapted to apply a printing material to the rotatable cylinder, the device comprising:

an elongate frame being disposed parallel to and outside the cylinder;

an elongate and spaced-apart doctor blade being mounted on each side of the elongated frame, said blades being disposed parallel to the cylinder and arranged, in an operative position, to be resiliently and wipingly applied against the cylinder, the blades, when in said operative position, defining, together with a surface of the elongate frame facing the cylinder and a circumferential surface of the cylinder, an elongate chamber which holds the printing material to be applied to the rotating cylinder; and the elongate frame including at least first and second elongate, interconnected metal sections, the first metal section being closest to the cylinder and having a substantially U-shaped cross-section, the U-shaped cross-section comprising a web located at a distance from the circumferential surface of the cylinder and two flanges on which the doctor blades are detachably mounted, an elongate portion of the elongate frame located between mounting places for the doctor blades forming an elongate stiffening or reinforcing portion, such that the frame constitutes a flexurally and torsionally rigid unit which in operation ensures a set constant distance between the elongate frame and the cylinder and, consequently, constant application of the blades against the circumferential surface of the cylinder.

13. A device as set forth in claim 12, wherein said interconnected metal sections are made of bent thin sheet-metal.

14. A device as set forth in claim 13, wherein said sheet-metal is stainless steel.

* * * * *

UNITED STATES PATENT AND TRADEMARK OFFICE

CERTIFICATE OF CORRECTION

PATENT NO. : 5,671,673

DATED : SEPTEMBER 30, 1997

INVENTOR(S) : BÖÖSE ET AL.

It is certified that error appears in the above-identified patent and that said Letters Patent is hereby corrected as shown below:

Cover page, please insert at the appropriate location —PCT Filed May 19, 1993—

Cover page: insert —[86] PCT No.: PCT/SE93/00447
§ 371 Date: Nov. 22, 1994
§ 102(e) Date: Nov. 22, 1994—

Signed and Sealed this

Ninth Day of January, 2001

*Attest:*

Q. TODD DICKINSON

*Attesting Officer*

*Commissioner of Patents and Trademarks*